US006628262B2

(12) United States Patent
Ichiraku

(10) Patent No.: US 6,628,262 B2
(45) Date of Patent: Sep. 30, 2003

(54) ACTIVE MATRIX DISPLAY APPARATUS CAPABLE OF DISPLAYING DATA EFFICIENTLY

(75) Inventor: Tsuyoshi Ichiraku, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 287 days.

(21) Appl. No.: 09/730,402

(22) Filed: Dec. 6, 2000

(65) Prior Publication Data

US 2001/0005195 A1 Jun. 28, 2001

(30) Foreign Application Priority Data

Dec. 22, 1999 (JP) ..... 11-363892

(51) Int. Cl.[7] ..... G09G 3/36
(52) U.S. Cl. ..... 345/100; 345/90; 345/98
(58) Field of Search ..... 345/87, 90, 92, 345/94, 98, 96, 100, 213, 216

(56) References Cited

U.S. PATENT DOCUMENTS 5,307,085 A * 4/1994 Nakamura ..... 345/99
6,014,126 A * 1/2000 Nishihara ..... 345/698
6,229,513 B1 * 5/2001 Nakano et al. ..... 345/99
6,320,562 B1 * 11/2001 Ueno et al. ..... 345/87
6,323,871 B1 * 11/2001 Fujiyoshi et al. ..... 345/598

FOREIGN PATENT DOCUMENTS

| | | |
|---|---|---|
| JP | 64-13193 | 1/1989 |
| JP | 6-18844 | 1/1994 |
| JP | 10-207434 | 8/1998 |

* cited by examiner

*Primary Examiner*—Richard Hjerpe
*Assistant Examiner*—Duc Q. Dinh
(74) *Attorney, Agent, or Firm*—Young & Thompson

(57) ABSTRACT

An active matrix type display apparatus includes a display panel, a horizontal display driver and a controller. The horizontal display driver includes m (m is an integer larger than 1) horizontal driving sections to drive the display panel based on m display data sets in response to an output clock signal, respectively. The controller generates the output clock signal from an input clock signal, and carries out sampling of input data to produce display data for a horizontal line of the display panel. Also, the controller sequentially stores the display data and outputs the stored display data to the m horizontal driving sections in units of display data sets in response to the output clock signal, respectively.

20 Claims, 3 Drawing Sheets

HCK-A

HCK-B

HDATA-A
D1
D2
D3
...
D128
D257
...

HDATA-B
D129
D130
D131
...
D256
D385
...

ACTIVE MATRIX DISPLAY APPARATUS CAPABLE OF DISPLAYING DATA EFFICIENTLY

BACKGROUND OF THE INVENTION

1. Field of the Invention

The present invention relates to an active matrix type display apparatus, in which a display panel can be efficiently driven.

2. Description of the Related Art

An active matrix display represented by a TFT liquid crystal display is typically composed of a display panel, a drive circuit for driving the display panel, and a controller for sending display data to the drive circuit. The operating frequency of the drive circuit is set to be lower than that of the controller. The controller reduces the transfer rate of the display data in accordance with the operating frequency of the driving circuit to transfer the display data to the drive circuit.

Technique for reducing the transfer rate of display data is disclosed in Japanese Laid Open Patent Applications (JP-A-Showa 64-13193, JP-A-Heisei 6-18844 and JP-A-Heisei 10-207434).

In the technique of Japanese Laid Open Patent Application (JP-A-Showa 64-13193), a data signal is divided into an odd-numbered data signal and an even-numbered data signal in order to drive an EL panel. The odd-numbered data signal and the even-numbered data signal are transferred in parallel with each other in synchronism with a half of the frequency of a reference clock signal so as to carry out the display control pixel by pixel. This technique does not consider the drive of an active matrix display such as a liquid crystal panel. The pixel-by-pixel drive control can be carried out under the presumption that the EL panel is driven. However, it is difficult to use the pixel-by-pixel drive control for the drive control of the active matrix type display apparatus.

In the technique of Japanese Laid Open Patent Application (JP-A-Heisei 6-18844), the bit of a display data signal is doubled. The doubled display data is transferred in synchronism with a half frequency of a reference clock signal.

In the technique of Japanese Laid Open Patent Application (JP-A-Heisei 10-207434), a source driver of a display panel is divided into a first half portion and a second half portion, and a line memory is similarly divided into two portions. Two data stored in the line memory are simultaneously supplied to the first and second portions of the source driver in synchronism with a half frequency of a reference clock signal. In this reference, display data required for the display of one line is stored in the line memory. After the completion of storing of the display data in the line memory, the display data for one line is simultaneously supplied to the display panel. In other words, this technology requires a line memory to have a capacity enough to store the display data for one line.

In this way, in the conventional active matrix type display apparatus, the operating clock of the drive circuit for driving the display panel can be set to be a half frequency of the reference clock signal. However, in order to perform frequency division of the clock, the arrangement of elements inevitably becomes complicated and a large capacity of memory is required. The large capacity of memory is equivalent to the memory having a capacity large enough to store display data for one line, for example, as in the technology disclosed in Japanese Laid Open Patent Application (JP-A-Heisei 10-207434).

SUMMARY OF THE INVENTION

Therefore, an object of the present invention is to provide an active matrix type display apparatus in which the storage capacity of a memory for temporarily storing display data can be significantly reduced.

Another object of the present invention is to provide an active matrix type display apparatus having good EMI characteristics.

In order to achieve an aspect of the present invention, an active matrix type display apparatus includes a display panel, a horizontal display driver and a controller. The horizontal display driver includes m (m is an integer larger than 1) horizontal driving sections to drive the display panel based on m display data sets in response to an output clock signal, respectively. The controller generates the output clock signal from an input clock signal, and carries out sampling of input data to produce display data for a horizontal line of the display panel. Also, the controller sequentially stores the display data and outputs the stored display data to the m horizontal driving sections in units of display data sets in response to the output clock signal, respectively.

Here, the controller may include a clock signal generating section which generates the output clock signal from the input clock signal. In this case, a frequency of the output clock signal is larger than that of the input clock signal.

Also, the output clock signal may include n (n is an integer larger than 1) clock signals, each of the m horizontal driving sections may include n driving sections, and the display data set may include n display data portions. At this time, the n driving sections drive the display panel based on the n display data portions of the display data set corresponding to the n driving sections in response to the n clock signals, respectively. In this case, n may be 2. In this case, the output clock signal may include first and second clock signals which are different in phase from each other by 180 degrees.

Also, the controller may include a dual port memory which sequentially stores the display data and outputs the stored display data to the m horizontal driving sections in units of display data sets in response to the output clock signal, respectively. In this case, it is desirable that the dual port memory operates in a first-in and first-out manner.

In order to achieve another aspect of the present invention, an active matrix type display apparatus includes a display panel, a horizontal display and a controller. The horizontal display driver includes m (m is an integer larger than 1) horizontal driving sections to drive the display panel based on m display data sets in response to an output clock signal, respectively. The controller generates the output clock signal from an input clock signal, and a frequency of the output clock signal is larger than that of the input clock signal. Also, the controller carries out sampling of input data to produce display data for a horizontal line of the display panel, and outputs the display data to the m horizontal driving sections in units of display data sets in response to the output clock signal, respectively.

Here, the output clock signal may include n (n is an integer larger than 1) clock signals, each of the m horizontal driving sections may include n driving sections, and the display data set may include n display data portions. At this time, the n driving sections drive the display panel based on the n display data portions of the display data set corresponding to the n driving sections in response to the n clock signals, respectively. In this case, n may be2. In this case, the output clock signal may include first and second clock signals which are different in phase from each other by 180 degrees.

Also, the controller may include a dual port memory which sequentially stores the display data and outputs the stored display data to the m horizontal driving sections in units of display data sets in response to the output clock signal, respectively. In this case, it is desirable that the dual port memory operates in a first-in and first-out manner.

In order to achieve still another aspect of the present invention, an active matrix type display apparatus includes a display panel, a horizontal display driver and a controller. The horizontal display driver set includes m (m is an integer larger than 1) horizontal driving sections to drive the display panel at different timings based on m display data sets in response to an output clock signal, respectively. The controller generates the output clock signal from an input clock signal, and a frequency of the output clock signal being larger than that of the input clock signal. Also, the controller carries out sampling of input data to produce display data for a horizontal line of the display panel, and outputs the display data to the m horizontal driving sections at the different timings in units of display data sets in response to the output clock signal, respectively.

Here, the output clock signal may include n (n is an integer larger than 1) clock signals, each of the m horizontal driving sections may include n driving sections, and the display data set may include n display data portions. At this time, the n driving sections drive the display panel based on the n display data portions of the display data set corresponding to the n driving sections in response to the n clock signals, respectively. In this case, n may be 2. In this case, the output clock signal may include first and second clock signals which are different in phase from each other by 180 degrees.

Also, the controller may include a dual port memory which sequentially stores the display data and outputs the stored display data to the m horizontal driving sections in units of display data sets in response to the output clock signal, respectively. In this case, it is desirable that the dual port memory operates in a first-in and first-out manner.

DESCRIPTION OF THE PREFERRED EMBODIMENTS

Hereinafter, an active matrix type display apparatus of the present invention will be described below detail with reference to the attached drawings.

Figure 1:
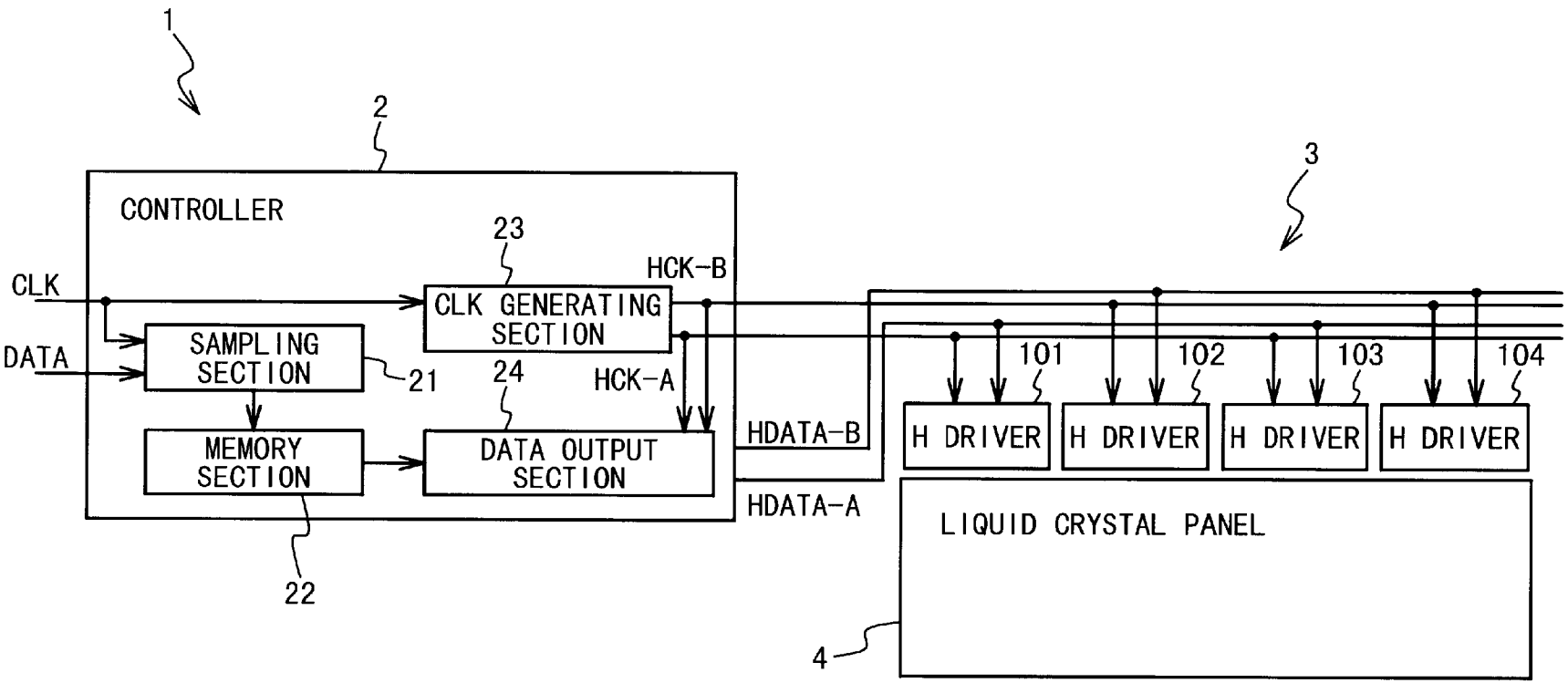
FIG. 1 shows the structure of an active matrix type display apparatus according to an embodiment of the present invention.

FIG. 1 shows the structure of an active matrix type display apparatus according to an embodiment of the present invention. The active matrix type display apparatus 1 shown in FIG. 1 is an example of a TFT liquid crystal display apparatus. The active matrix type display apparatus 1 is composed of a controller 2, a drive circuit 3, and a liquid crystal display panel 4. The controller 2 is composed of a sampling section 21, a memory section 22, a clock (CLK) generating section 23, and a data output section 24. The drive circuit 3 is composed of first to fourth horizontal (H) drivers 101 to 104. In this embodiment, each of the first to fourth horizontal drivers 101 to 104 is composed of a two-port driver having a port A and a port B. Of a group of input display data, odd-numbered input display data are supplied to the port A and even-numbered display data are supplied to the port B.

The sampling section 21 is composed of a logic circuits of flip-flop circuits and carries out the sampling of input display data DATA in synchronism with a reference clock CLK of the display apparatus 1. The sampling section 21 outputs the sampled display data to the memory section 22. The memory section 22 is composed of a dual port memory or first to fourth FIFO memories (not shown) for temporarily storing the input display data DATA sampled by the sampling section 21. The memory section 22 carries out an input operation and an output operation in a first-in first-out (FIFO) manner. In this embodiment, the storage capacity of the memory section 22 is set to be less than the data quantity for one line of the display panel.

The clock generating section 23 is composed of a frequency divider for dividing the frequency of the reference clock CLK to ½. The clock generating section 23 generates a first frequency-division clock signal HCK-A and a second frequency-division clock signal HCK-B, which are different in phase from each other by 180 degree. The data output section 24 is composed of a gate circuit which transfers data outputted from the memory section 22 in synchronism with the first frequency-division clock signal HCK-A or the second frequency-division clock signal HCK-B. The data output section 24 outputs first output display data HDATA-A and second output display data HDATA-B. The first output display data HDATA-A is outputted from the memory section 22 in synchronism with the first frequency-division clock signal HCK-A. The second output display data HDATA-B is outputted from the memory section 22 in synchronism with the second frequency-division clock signal HCK-B.

The first frequency-division clock signal HCK-A and the first output display data HDATA-A are supplied to the first and third horizontal drivers 101 and 103 (odd-numbered horizontal drivers) of a first horizontal driver group. The second frequency-division clock signal HCK-B and the second output display data HDATA-B are supplied to the second and fourth horizontal drivers 102 and 104 (even-numbered horizontal drivers) of a second horizontal driver group.

The liquid crystal panel 4 is supposed to be composed of a display panel having 1280×1024 pixels. In this case, one line is composed of a row of 3840 dots (3840 color bits), if three dots for a red (R) dot, a green (G) dot, and a blue (B) dot are regarded as one pixel. When one horizontal driver drives 384 dots as a set of display data dots, ten horizontal drivers are provided. A first horizontal driver 101 drives a first group of 384 dots on the line, and the second horizontal driver 102 drives a second group of 384 dots on the line. Also, the third horizontal driver 103 drives a third group of 384 dots on the line, and the fourth horizontal driver 103 drives a fourth group of 384 dots on the line. Sequentially, groups of dots to be driven are allocated for fifth to tenth horizontal drivers (not shown).

Next, the operation of the active matrix type display apparatus of the present invention will be described below with reference to FIGS. 2A and 2B. In the following description, a set of display data is supposed to be for 128 pixels.

Figure 2A:
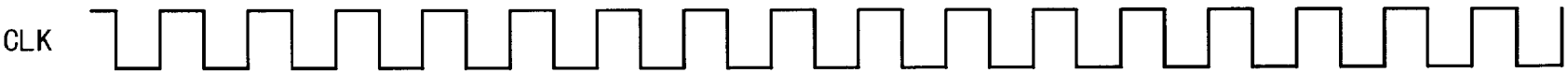
FIGS. 2A and 2B are timing charts showing an operation of a memory section of the present invention.
Figure 2B:
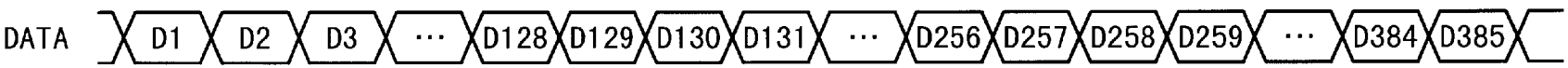

The sampling section 21 carries out the sampling of input display data in synchronism with the falling timing of the reference clock signal CLK shown in FIG. 2A. Thus, the sampled display data are obtained as shown in FIG. 2B. The sampled display data are supplied to the memory section 22. In this case, the first 256 display data are supplied to the first FIFO memory of the memory section 22, and the second 256 display data are supplied to the second FIFO memory of the memory section 22. Also, the third 256 display data are supplied to the third FIFO memory of the memory section 22, and the fourth 256 display data are supplied to the fourth FIFO memory of the memory section 22. Then, the fifth 256 display data are supplied to the first FIFO memory of the memory section 22 again.

More specifically, when the sampled display data DATA are composed of first data D1 to 128th data D128, the first port data A is composed of the first data D1, the third data D3, . . . , and the 127th data D127. In addition, the second port data B is composed of the second data D2, the fourth data D4, . . . , and the 128th data D128. The first FIFO memory of the memory section 22 stores the first data D1 to the 128th data D128 in sequence.

When the sampled display data DATA are composed of a 129th data D129 to a 256th data D256, the first port data A is composed of the 129th data D129, the 131st data D131, . . . , and the 255th data D255. The second port data B is composed of the 130th data D130, the 132nd data D132, . . . , and the 256th data D256. The second FIFO memory of the memory section 22 stores the first data D129 to the 256th data D256 in sequence.

The sampling section 21 continues to carry out the sampling of the input display data in synchronism with the falling timing of the reference clock signal CLK. After the sampling of the 256th data D256, the sampling section 21 outputs the 257th data D257 and subsequent data. At this time, the sampled display data are supplied to the third and fourth FIFO memories of the memory section 22 sequentially.

After the sampling section 21 carries out the sampling of the 3840th data D3840, the whole display data for one line of the liquid crystal display panel 4 is provided. Thus, an image for one line corresponding to the input display data can be displayed on the display panel 4.

Next, the output operation of the display data from the memory section 22 will be described below with reference to FIGS. 3A to 3D.

Figures 3A, 3B, 3C, 3D:
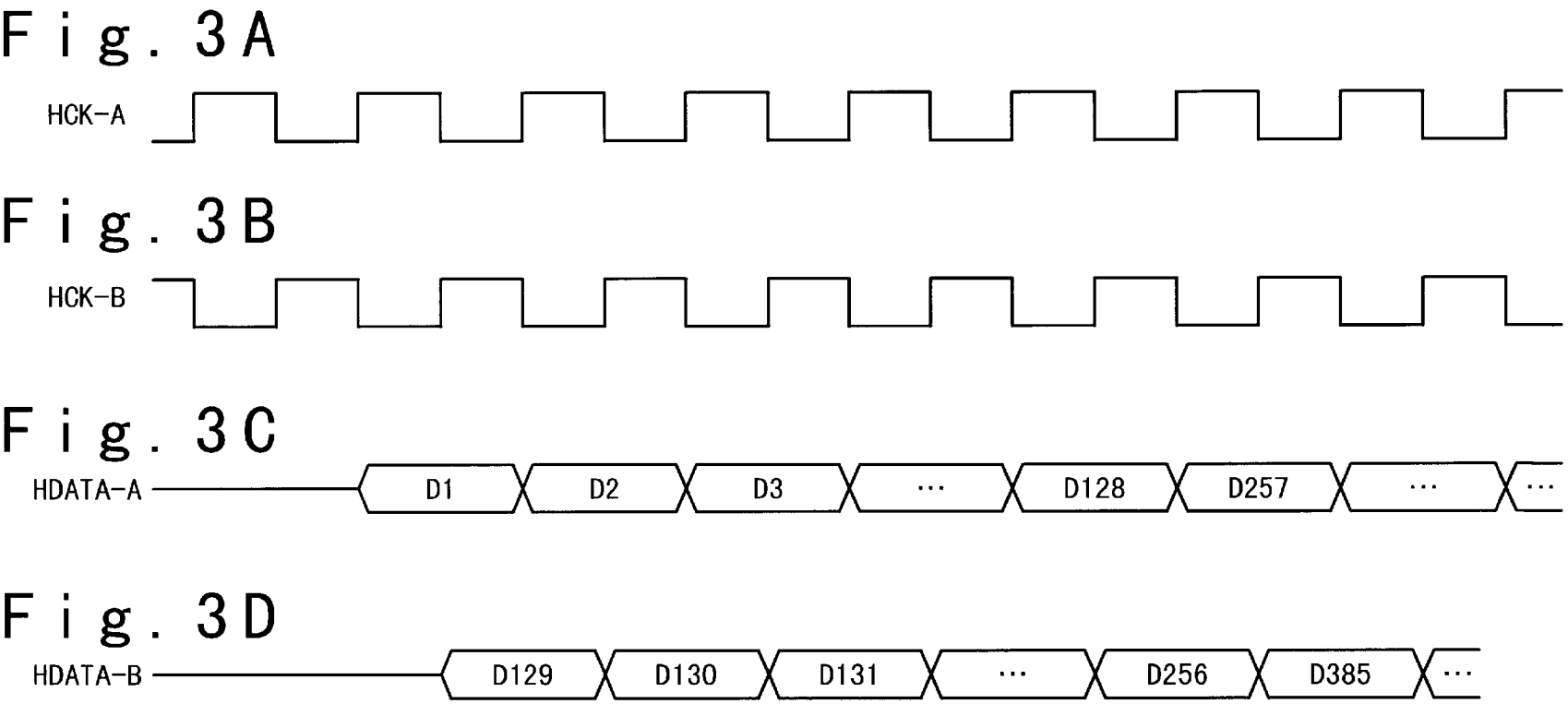
FIGS. 3A to 3D are timing charts showing another operation of the memory section of the present invention.

When the third FIFO memory of the memory section 22 stores the 257th data D257, the first FIFO memory of the memory section 22 outputs the first data D1 to the data output section 24, as shown in FIG. 3C. When the third FIFO memory of the memory section 22 stores the 258th data D258, the second FIFO memory of the memory section 22 outputs the 129th data D129 to the data output section 22, as shown in FIG. 3D. When the third FIFO memory of the memory section 22 stores the 259th data D259, the first FIFO memory of the memory section 24 outputs the second data D2 to the data output section 24, as shown in FIG. 3C. When the third FIFO memory of the memory section 22 stores the 260th data D260, the second FIFO memory of the memory section 22 outputs the 130th data D130 to the data output section 24, as shown in FIG. 3D.

The first and third FIFO memories of the memory section 22 carry out the output operation of the display data to the data output section 24 in synchronism with the rising timing of the first frequency-division clock signal HCK-A shown in FIG. 3A. Thus, the first display data HDATA-A composed of the first port data and the second port data are supplied to the first and third horizontal drivers 101 and 103, respectively, as shown in FIG. 3C. For example, the first port data are composed of the first data D1, the third data D3, and the fifth data D5 to the 127th data D127, and the second port data are composed of the second data D2, the fourth data D4, and the sixth data D6 to the 128th data D128.

The second and fourth FIFO memories of the memory section 22 carry out the output operation of the display data to the data output section 24 in synchronism with the rising timing of the second frequency-division clock signal HCK-B shown in FIG. 3B. Thus, the second display data HDATA-B composed of the first port data and the second port data are supplied to the second and fourth horizontal drivers 102 and 104, respectively, as shown in FIG. 3D. For example, the first port data are composed of the 129th data D129, the 131st data D131, and the 133rd data D133 to the 383rd data D383, and the second port data are composed of the 130th data D130, the 132nd data D132, and the 134th data D134 to the 512th data D512.

The data output section 24 outputs the first port data composed of the first data D1, the third data D3, and the fifth data D5 to the 127th data D127 to the port A of the first horizontal driver 101. The first horizontal driver 101 receives the first port data in synchronism with the first frequency-division clock signal HCK-A. Also, the data output section 24 outputs the second port data composed of the second data D2, the fourth data D4, and the sixth data D6 to the 128th data D128 to the port B of the first horizontal driver 101. The first horizontal driver 101 receives the second port data in synchronism with the first frequency-division clock signal HCK-A.

The data output section 24 outputs the first port data composed of the 129th data D129, the 131st data D131, and the 133rd data D133 to the 255th data D255 to the port A of the second horizontal driver 102. The second horizontal driver 102 receives the first port data in synchronism with the second frequency-division clock signal HCK-B. Also, the data output section 24 outputs the second port data composed of the 130th data D130, the 132nd data D132, and the 134th data D134 to the 256th data D256 to the port B of the second horizontal driver 102. The second horizontal driver 102 receives the second port data in synchronism with the second frequency-division clock signal HCK-B.

After the completion of outputting of the 256th data D256, the data output section 24 receives the 257th data D257 and subsequent data from the third and fourth FIFO memories of the memory section 22 to output to the third and fourth horizontal drivers 103 and 104.

As described above, the display apparatus 1 repeats the same processing while driving the two horizontal drivers as one unit during the same output cycle. The controller 2 can carry out the processing without causing any trouble in the storage of new data, if the memory section 22 having a capacity necessary to drive the two horizontal drivers is provided.

Since there is a phase difference of 180 degrees between the first frequency-division clock signal HCK-A and the second frequency-division clock signal HCK-B, the output timing of the first display data HDATA-A differs from the output timing of the second display data HDATA-B. The phase difference or timing difference allows the number of concurrently changing signals to be decreased. The decrease in the number of the concurrently changing signals leads to reduction in the occurrence of EMI.

The present invention is not limited to the above embodiments. For example, when the timings of input and output to and from the memory section 22 are more finely controlled, it is possible to reduce the capacity of the memory section 22 to the capacity necessary to drive one horizontal driver. Moreover, the number of horizontal drivers may be determined depending on the ratio of frequency division of the clock signal generating section 23 and the number of pixels of the liquid crystal panel.

In the active matrix type display apparatus according to the present invention, the storage region of the memory can be used with efficiency. As a result, the capacity of the memory can be significantly reduced, as compared with the conventional example in which the memory capacity necessary to store display data for one line is required.

Also, in the active matrix display according to the present invention, there is a difference between the timings of transferring data to a pair of horizontal drivers. Thus, the number of signals changing at one time can be reduced. As a result, the occurrence of EMI can be reduced.

What is claimed is:

1. An active matrix display apparatus, comprising:

a display panel;

a controller; and a drive circuit, the controller having a data input, M (M being an integer larger than 1) clock outputs, and M data outputs, the controller comprising a sampling section connected to the data input and synchronized with a reference clock signal, a memory section connected to the sampling section, a data output section connected to the memory section to supply output display data via the M data outputs, and a clock generating section connected to the reference clock signal, the data output section and to the M clock outputs, the drive circuit comprising N (N being an integer multiple of M) horizontal drivers connected to the M clock outputs to receive clock signals, to the M data outputs to receive the output display data and to the display panel to drive the display panel, each of the horizontal drivers comprises a two-port driver with a port A and a port B, wherein of a group of output display data supplied by the data output section to one driver, odd-numbered data are supplied only to the port A and even-numbered data are supplied only to the port B.

2. The display apparatus of claim 1, wherein, the sampling section carries out a sampling of input display data in synchronism with the reference clock and outputs the sampled input display data to the memory section, the memory section is composed of a dual port memory having four FIFO memories, and odd-numbered sampled display data is stored only in a port A of the memory section and even-numbered sampled display data is stored only in a port B of the memory section.

3. The display apparatus of claim 2, wherein a storage capacity of the memory section is less than a data quantity necessary for one horizontal line of the display panel.

4. The display apparatus of claim 1, wherein, the clock generating section comprises a frequency divider for dividing a frequency of the reference clock and generating M clock signals to the M clock outputs, the M clock signals are out of phase with each other, and the M clock signals have a frequency less than the frequency of the reference clock.

5. The display apparatus of claim 4, wherein, the clock generating section generates a clock signal A and a clock signal B differing in phase from each other by 180 degrees, the data output section comprises a circuit to transfer the input display data output from the memory section in synchronism with clock signal A and the clock signal B as a first output display data and a second output display data, respectively, and the first output display data and the second output display data are transferred out of the memory section at different times from each other.

6. The display apparatus of claim 5, wherein, the clock signal A is supplied only to the odd-numbered drivers and the clock signal B is supplied only to the even-numbered drivers, and the first output display data are only transferred to odd-numbered horizontal drivers and the second output display data are only transferred to even-numbered drivers.

7. The display apparatus of claim 2, wherein, the controller initially stores sampled data in a first FIFO memory and a second FIFO memory of the four FIFO memories of the memory section, and the controller, upon commencing storing sampled data in a third FIFO memory of the four FIFO memories of the memory section, commences outputting, alternatingly, stored sampled data from the first FIFO memory and the second FIFO memory to the data output section.

8. The display apparatus of claim 7, wherein, the clock generating section comprises a frequency divider for dividing a frequency of the reference clock and generating a clock signal A and a clock signal B which clock signals differ in phase from each other and are a lower frequency than the frequency of the reference clock, the data output section comprises a circuit to transfer the stored sampled display data output from the memory section in synchronism with the clock signal A and the clock signal B as a first output display data and a second output display data, respectively, the first output display data and the second output display data are transferred out of the memory section at different times from each other and the first output display data are only transferred to odd-numbered horizontal drivers and the second output display data are only transferred to even-numbered drivers, and the clock signal A is supplied to the odd-numbered drivers and the clock signal B is supplied to the even-numbered drivers.

9. The display apparatus of claim 1, where each horizontal display driver drives plural horizontal color dots of the display panel.

10. The display apparatus of claim 2, wherein, odd-numbered sampled display data stored in the port A of each memory section and even-numbered sampled display data stored only in the port B of each memory section are respectively transferred only to the port A and only to the port B of the horizontal drivers.

11. An active matrix display apparatus, comprising:

a display panel;

a controller having a data input, M (M being an integer larger than 1) clock outputs, and M data outputs; and a drive circuit with N (N being an integer multiple of M) driving sections, each of the M clock outputs being connected to a set of N/M driving sections and free of connection to other driving sections, each of the M data outputs being connected to one set of N/M driving sections and free of connection to other driving sections, each driving section within any one set of N/M driving sections being connected to the same clock output and the same data output, wherein, the controller i) generates at each of the M clock outputs, clock signals so that only one set of N/M driving sections is activated at any one time and the generated clock signals are out of phase with each other, and ii) in coordination with activating each set of the N/M driving sections, outputs display data to one set of N/M driving sections.

12. An active matrix display apparatus, comprising:

a display panel;

a controller; and a drive circuit, the controller having a data input, plural clock outputs, and plural data outputs, the controller comprising a sampling section connected to the data input and synchronized with a reference clock signal, a memory section connected to the sampling section, a data output section connected to the memory section to supply output display data via the plural data outputs, and a clock generating section, the drive circuit comprising plural horizontal drivers having a port A and a port B, each of the horizontal drivers connected to one of the clock outputs to receive clock signals and to one of the data outputs to receive the output display data and to the display panel to drive the display panel, each of the clock outputs being connected to plural horizontal drivers and each of the data outputs being connected to plural horizontal drivers, wherein of a group of output display data supplied by one data output of the controller to one horizontal driver, odd-numbered data are supplied only to the port A and even-numbered data are supplied only to the port B of the horizontal driver.

13. The display apparatus of claim 12, wherein, the sampling section carries out a sampling of input display data in synchronism with the reference clock and outputs the sampled input display data to the memory section, the memory section is composed of a dual port memory, and odd-numbered sampled display data is stored only in a port A of the memory section and even-numbered sampled display data is stored only in a port B of the memory section.

14. The display apparatus of claim 12, wherein, the clock generating section comprises a frequency divider for dividing a frequency of the reference clock and generating M clock signals to the M clock outputs, the M clock signals are out of phase with each other, and the M clock signals have a frequency less than the frequency of the reference clock.

15. The display apparatus of claim 14, wherein, the clock generating section generates a clock signal A and a clock signal B differing in phase from each other by 180 degrees, the data output section comprises a circuit to transfer the input display data output from the memory section in synchronism with clock signal A and the clock signal B as a firsr output display data and a second output display data, respectively, and the first output display data and the second output display data are transferred out of the memory section at different times from each other.

16. The display apparatus of claim 15, wherein, the clock signal A is supplied only to the odd-numbered drivers and the clock signal B is supplied only to the even-numbered drivers, and the first output display data are only transferred to odd-numbered horizontal drivers and the second output display data are only transferred to even-numbered drivers.

17. The display apparatus of claim 12, wherein, the memory section comprises at least four FIFO memories, the memory section first stores sampled data in a first FIFO memory and a second FIFO memory of the four FIFO memories of the memory section, and the controller, upon commencing storing sampled data in a third FIFO memory of the four FIFO memories of the memory section, commences outputting, alternatingly, stored sampled data from the first FIFO memory and the second FIFO memory to the data output section.

18. The display apparatus of claim 17, wherein, the clock generating section comprises a frequency divider for dividing a frequency of the reference clock and generating a clock signal A and a clock signal B which clock signals differ in phase from each other and are a lower frequency than the frequency of the reference clock, the data output section comprises a circuit to transfer the stored sampled display data output from the memory section in synchronism with the clock signal A and the clock signal B as a first output display data and a second output display data, respectively, the first output display data and the second output display data are transferred out of the memory section at different times from each other and the first output display data are only transferred to odd-numbered horizontal drivers and the second output display data are only transferred to even-numbered drivers.

19. The display apparatus of claim 12, where each horizontal display driver drives plural horizontal color dots of the display panel.

20. The display apparatus of claim 13, wherein, odd-numbered sampled display data stored in the port A of each memory section and even-numbered sampled display data stored only in the port B of each memory section are respectively transferred only to the port A and only to the port B of the horizontal drivers.

* * * * *